US007617026B2

(12) United States Patent
Gee et al.

(10) Patent No.: US 7,617,026 B2
(45) Date of Patent: Nov. 10, 2009

(54) PROGRAMMABLE TRIM CONTROL SYSTEM FOR MARINE APPLICATIONS

(75) Inventors: Michael B. Gee, Racine, WI (US); Dana L. Birkland, Racine, WI (US); Robert B. Bertolasi, Rockford, IL (US); Darryl S. Babu, Racine, WI (US); Klaus Meyersieck, Kenosha, WI (US); Dean J. Bratel, New Berlin, WI (US); David D. N. Vann, Tampa, FL (US); Steven B. Hall, Racine, WI (US); Mark B. Wilson, Palm City, FL (US); Russel E. Gates, Racine, WI (US); Frederic E. Nystrom, Racine, WI (US); Robert N. Schenk, Racine, WI (US)

(73) Assignee: Twin Disc Incorporated, Racine, WI (US)

( * ) Notice: Subject to any disclaimer, the term of this patent is extended or adjusted under 35 U.S.C. 154(b) by 414 days.

(21) Appl. No.: 11/436,072

(22) Filed: May 17, 2006

(65) Prior Publication Data

US 2007/0284475 A1 Dec. 13, 2007

(51) Int. Cl.
*B60L 3/00* (2006.01)

(52) U.S. Cl. ..... 701/21; 701/36

(58) Field of Classification Search ..... 701/1, 701/21, 123, 42, 43, 44, 36; 703/2; 440/1; 114/144 E, 144 RE
See application file for complete search history.

(56) References Cited

U.S. PATENT DOCUMENTS

| | | | | |
|---|---|---|---|---|
| 5,385,110 | A | 1/1995 | Bennett et al. | |
| 6,458,003 | B1 | 10/2002 | Krueger | |
| 6,904,341 | B2 | 6/2005 | Kish et al. | |
| 7,036,445 | B2 * | 5/2006 | Kaufmann et al. | 114/144 RE |
| 7,389,165 | B2 * | 6/2008 | Kaji | 701/21 |

* cited by examiner

*Primary Examiner*—Richard M. Camby
(74) *Attorney, Agent, or Firm*—von Briesen & Roper, s.c.

(57) ABSTRACT

A programmable trim control system for marine applications preferably includes a controller, a control panel, a display device and a plurality of sensors. The controller receives input from the control panel and the plurality of sensors. The display device acts as a monitor for the controller. Each sensor monitors a single drive device, trim device or operational parameter. The controller further includes output ports connected to the drive devices and trim devices for controlling thereof. The trim control system preferably includes a manual mode, a diagnostic mode, a program mode and a preset mode. The positions or settings of the trim and drive devices are set in the program mode and recorded in the controller. Data stored in the controller will be accessed by the trim control system when in the preset mode.

21 Claims, 5 Drawing Sheets

PROGRAMMABLE TRIM CONTROL SYSTEM FOR MARINE APPLICATIONS

BACKGROUND OF THE INVENTION

1. Field of the Invention

The present invention relates generally to marine trim systems and more specifically to a programmable trim control system for marine applications, which allows programming of the position of various trim and drive devices for recall in a preset mode.

2. Discussion of the Prior Art

A marine vessel utilizing articulated surface drive requires manual input from the operator to set drive and trim devices to obtain optimum vessel performance. To achieve the goal of optimum performance, manual manipulation of the drive and trim device settings is required during dynamic changes of the vessel. The dynamic changes include acceleration, engine speed, sea state, hull speed, hull inclination and many other factors. Awareness by the operator of all vessel performance characteristics is essential for proper setting of the drive and trim devices. However, constant manual manipulation of the drive and trim device positions deters the operator from the awareness of the surrounding environment.

The prior art includes several patents that disclose monitoring and/or controlling the operation of various trim devices or performance parameters. U.S. Pat. No. 5,263,432 to Davis discloses an automatic trim tab control for power boats. The Davis patent includes adjustment of a power boat's trim tabs, which are automated through all phases of the operation of the boat. The boat's speed and/or revolutions of its engine(s) are sensed.

U.S. Pat. No. 5,385,110 to Bennett et al. discloses a boat trim control and monitor system. The Bennett et al. patent includes a boat trim control system for selectively adjusting the trim tabs to maintain a desired boat attitude under varying load and sea conditions.

U.S. Pat. No. 5,474,012 to Yamada et al. discloses an automatic control for trim tabs. The Yamada et al. patent includes monitoring a marine transportation system to provide an output distinguishing boat operation in an on-plane condition and boat operation in an off-plane condition.

U.S. Pat. No. 5,474,013 to Wittmaier discloses a trim tab auto-retract and multiple switching devices. The Wittmaier patent includes an electro-mechanical control circuit for causing trim tabs attached to the stern of a hull of a motorized marine vessel to be automatically and fully retracted by activating means independent of the boat ignition switch.

U.S. Pat. No. 6,273,771 to Buckley et al. discloses a control system for a marine vessel. The Buckley et al. patent includes a control system for a marine vessel, which incorporates a marine propulsion system that can be attached to a marine vessel and connected in signal communication with a serial communication bus and controller. A plurality of input devices and output devices are also connected in signal communication with the communication bus and a bus access manager.

Accordingly, there is a clearly felt need in the art for a programmable trim control system for marine applications, which allows an operator to program drive and trim devices to attain optimum or desired performance.

SUMMARY OF THE INVENTION

The present invention provides a programmable control system for marine applications, which allows programming of various trim and drive devices for recall in a preset mode. The programmable trim control system for marine applications (trim control system) preferably includes a controller, a control panel, a display device and a plurality of sensors. The controller is any suitable microprocessor based controller. The control panel includes a plurality of input actuators, which are connected to the controller. The display device includes the ability to display instructions concerning operation of the trim control system; and information concerning the drive and trim devices, such as position and diagnostics. Each sensor monitors a single drive device, trim device or operational parameter. Each sensor is connected to an input port of the controller. The controller further includes output ports connected to a propulsion system, the drive devices and trim devices to control thereof.

The trim control system preferably includes a manual mode, a diagnostic mode, a program mode and a preset mode. The type of mode is selected through an input actuator on the control panel. An operator will place the trim control system in the program mode to manually set and store various positions of the trim and drive devices. The positions are determined by operator preference, and may be based on operational parameters such as throttle position, engine speed, vessel speed and any other parameters, all of which are preferably capable of being monitored on the display device. Programmed (or stored) positions will be accessed by the trim control system, when in the preset mode.

When the trim control system is in the manual mode; the operator is able to set the positions of the drive and trim devices manually. The trim control system will not intervene in the manual mode.

Accordingly, it is an object of the present invention to provide a trim control system, which allows an operator to preprogram drive and trim devices to attain optimum or desired performance.

These and additional objects, advantages, features and benefits of the present invention will become apparent from the following specification.

DETAILED DESCRIPTION OF THE PREFERRED EMBODIMENTS

Figure 1:
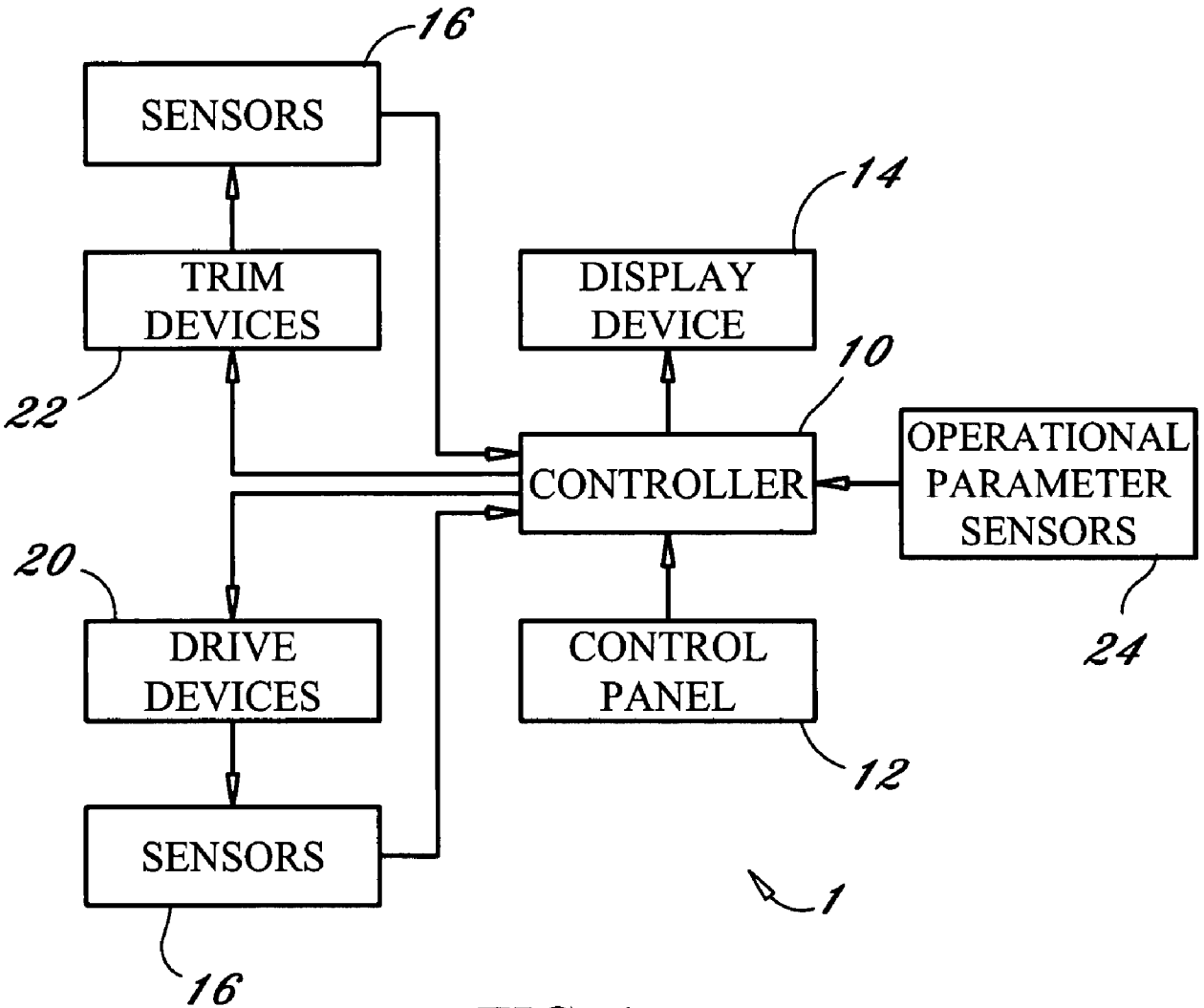
FIG. 1 is a block diagram of a trim control system in accordance with the present invention.
Figure 2:
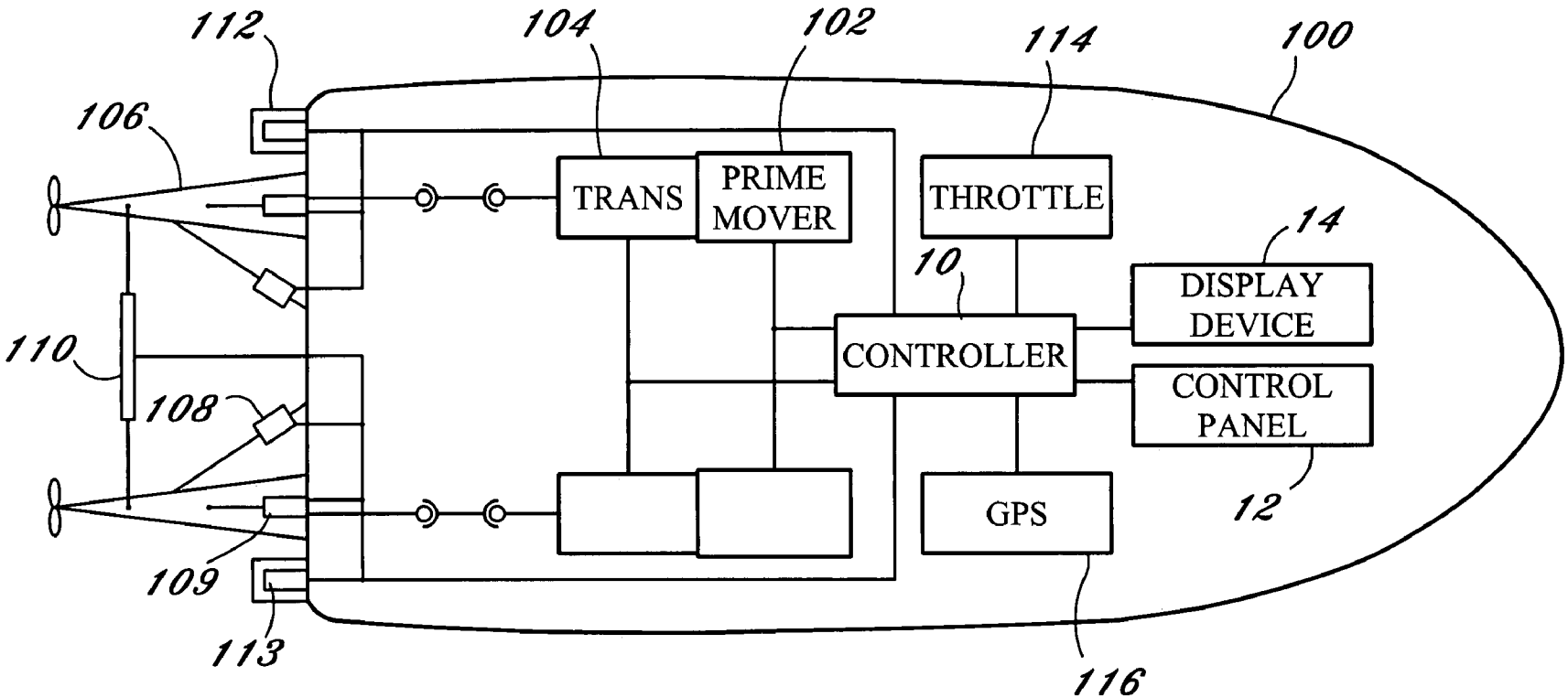
FIG. 2 is a schematic diagram of marine vessel having a trim control system in accordance with the present invention.
Figure 3:
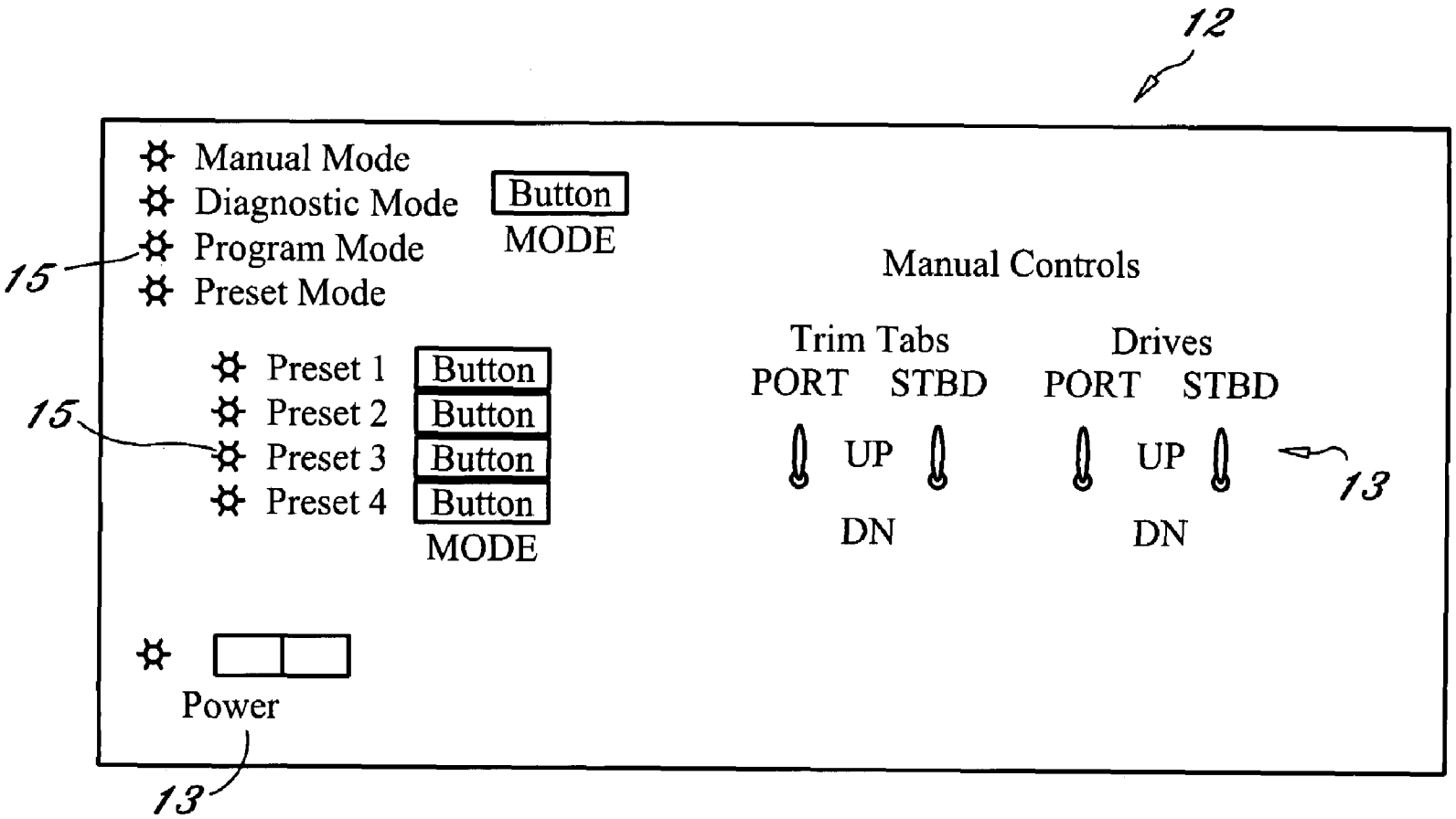
FIG. 3 is a front view of a control panel of a trim control system in accordance with the present invention.
Figure 4:
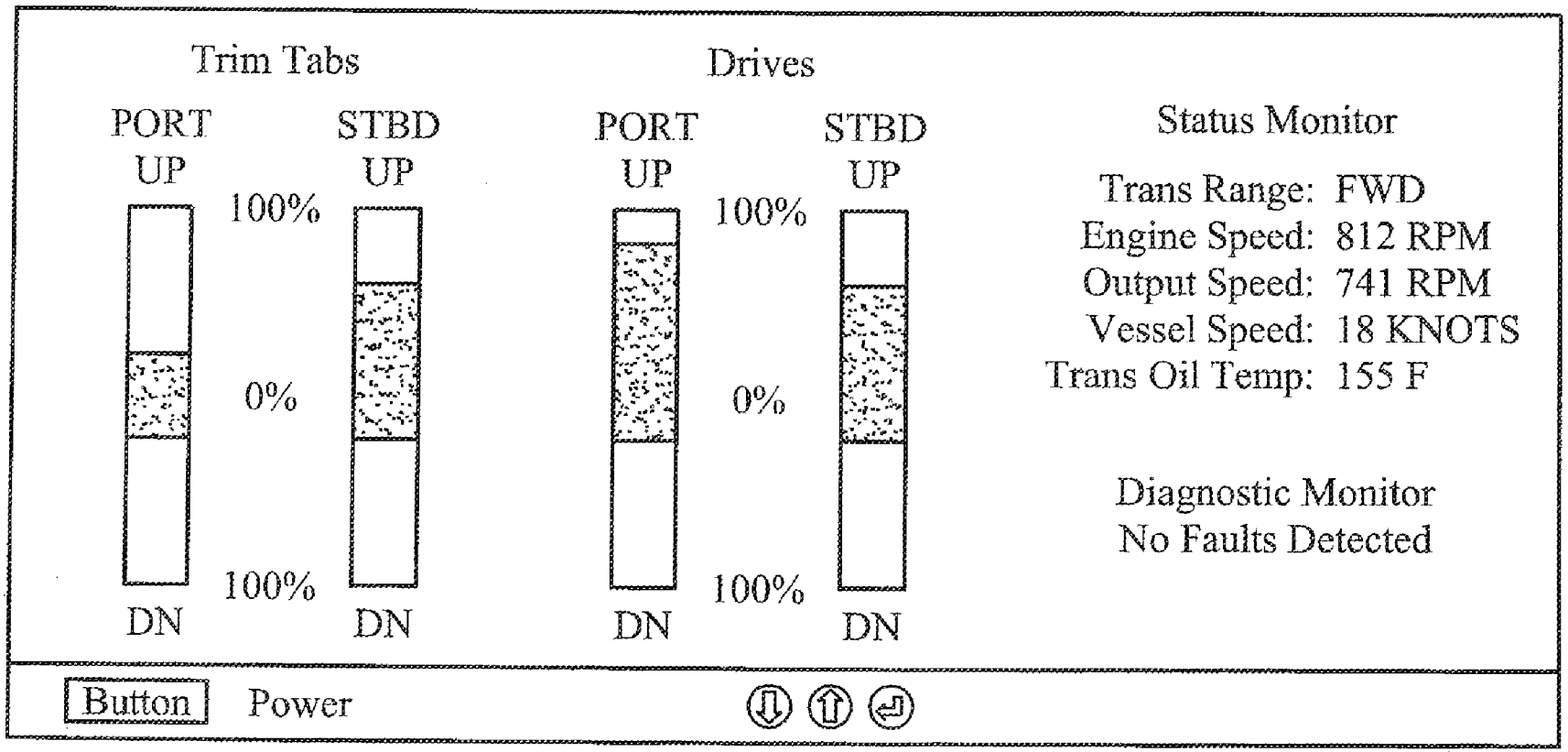
FIG. 4 is a front view of a display device of a trim control system in accordance with the present invention.

With reference to the drawings, and particularly to FIG. 1, there is shown a block diagram of a trim control system 1. With reference to FIG. 2, the trim control system 1 preferably includes a controller 10, a control panel 12, a display device 14 and a plurality of sensors 16. The controller 10 is any suitable microprocessor based programmable controller including memory, input ports and output ports. With reference to FIG. 3, the control panel 12 includes a plurality of input actuators 13, such as a touch pad, push-button switches, toggle switches, rotary switches or any other suitable input actuators. The input actuators are electrically connected to the controller 10. The control panel 12 further preferably includes indicator lights 15, such as preset lights, mode lights and any other suitable indicator lights. However, other control panels with other features may also be used.

The display device 14 is preferably a liquid crystal display, but other types of displays may also be used. The display device 14 preferably includes the display of instructions concerning operation of the trim control system 1; and information concerning drive devices 20 and trim devices 22, such as position and diagnostics. The drive devices 20 include at least one prime mover 102, at least one transmission 104, at least one outdrive propulsion system 106, at least one steering actuator 108, at least one drive trim actuator 109, a tie bar 110 (for multiple drive systems) and any other component having a drive function of a marine vessel 100. The prime mover 102 could be an engine, electric motor, gas turbine or any other suitable power source. The trim devices 22 include trim tabs 112, trim actuators 113, interceptor plates, rocker plates and any other trim device. Each sensor 16 monitors a single drive device 20, trim device 22 or operational parameter 24. Each sensor 16 will indicate the actual position or setting of the drive or trim device. Devices sensing the actual position of the drive and trim devices are well known in the art and need not be explained in detail.

Figure 5:
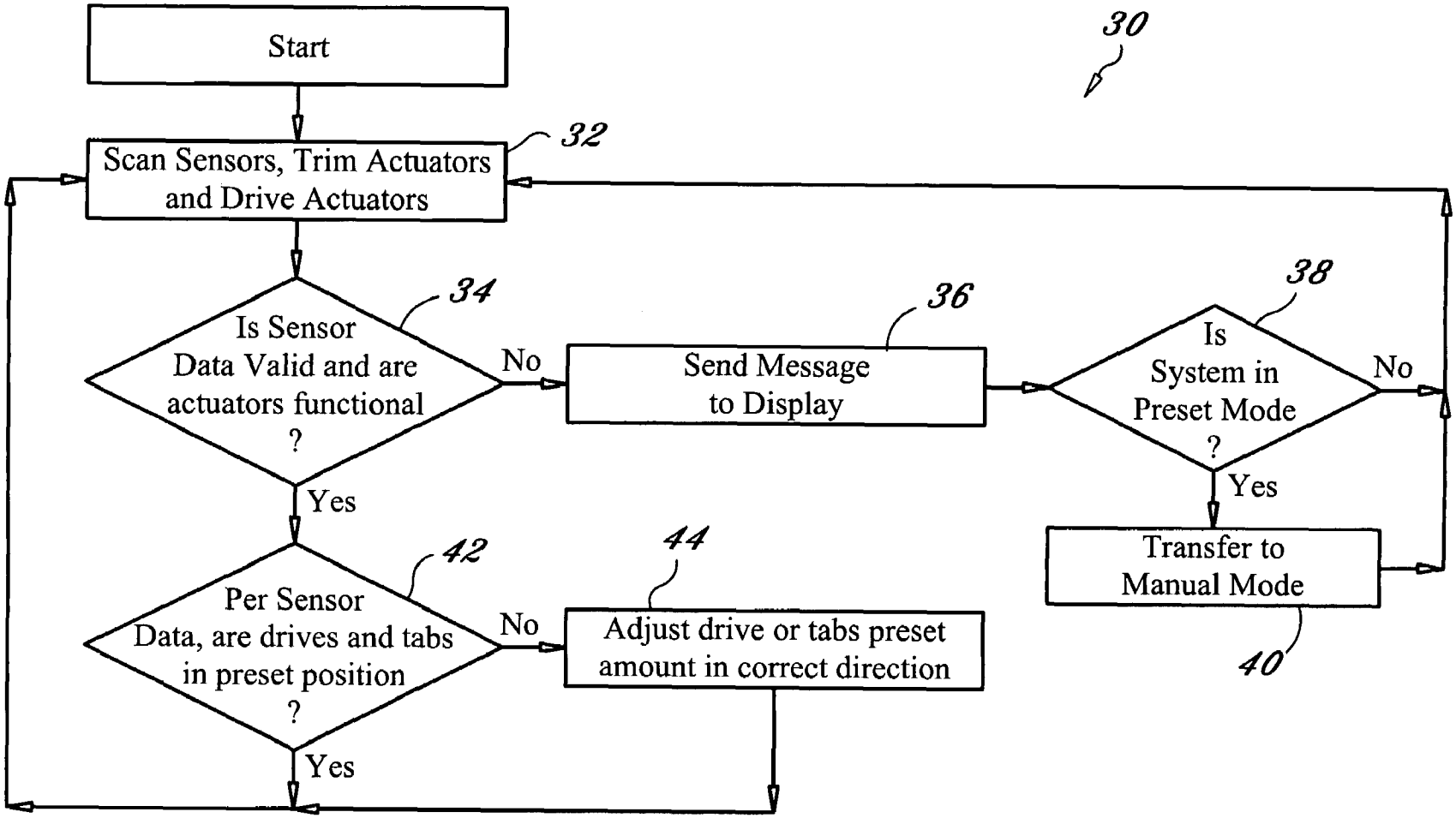
FIG. 5 is a flow chart of a data processing between a plurality of sensors, trim devices and drive devices of a trim control system in accordance with the present invention.

With reference to FIG. 5, a flow chart 30 discloses data processing between a plurality of sensors 16, a plurality of drive devices 20 and a plurality of trim devices 22 and a software program in the controller 10. The software program starts by scanning the plurality of sensors 16, actuators of the plurality of drive devices 20 and actuators of the plurality of trim devices 22 in process block 32. Scanning the plurality of sensors 16 provides the position of the plurality of drive and trim devices. The actuators of the plurality of drive and trim devices are scanned to determine if they are connected to the controller 10. An electrical signal from each of the plurality of sensors 16 is read to determine its validity. The electrical signal is also read to determine drive and trim device positions, and the actuators of the plurality of drive and trim devices are tested for continuity to determine functionality in decision block 34.

If the data from any of the plurality of sensors is invalid, or if any of the actuators are non-functional; then a message is sent to the display device 14 in process block 36 to display "Sensor Data Invalid or Actuator Nonfunctional." The control system is checked in decision block 38 to see, if it is in preset mode. If the control system is not in preset mode, then the program returns to process block 32. If the control system is in preset mode then the program transfers to manual mode in process block 40 and then returns to process block 32. If the data from the plurality of sensors 16 is valid and the actuators are functional, then the program determines whether the drive and trim devices are in a preset position in decision block 42. If the drive and trim devices are in a preset position, then the program returns to process block 32. If the drive and trim devices are not in a preset position, then the control system adjusts the drive and trim devices to be in the preset position in process block 44 and then the software program returns to process block 32.

Operational parameters 24 include vessel speed, engine rpm, engine load, hull inclination, sea conditions, wind velocity, wind direction and any other performance affecting parameter. Each sensor 16 is connected to an input port of the controller 10. A throttle 114 and a GPS device 116 are also preferably connected to inputs of the controller 10. The controller 10 further includes output ports connected to the drive devices 20 and the trim devices 22 to control thereof. The controller 10 includes fault detection for input and output ports, when the controller 10 is operational. In preset or manual modes, the controller 10 will continuously monitor the system for faults. The type of faults monitored include electrical opens, electrical shorts, out-of-tolerance measurements and any other appropriate information. If a fault is detected or limit exceeded; a warning is generated.

The warning may be generated as an advisory message shown on the display device 14. An attempt is also made by the controller 10 to initiate an automatic system reconfiguration to sustain the current mode of operation. In cases where it is inadvisable to continue in the current mode of operation, an automatic reversion to a less capable mode, such as manual mode may be implemented automatically. The less capable mode may also be made subject to operator approval as determined for a particular application and dependent on the particular fault detected. Further, upon power-up of the controller 10, a power-on-self-test may be performed. The power-on-self-test includes a predetermined set of tests executed to confirm the operational status of the controller 10. Normal operations are inhibited, until completion of the power-on-self-test. Normal operations may be inhibited indefinitely, depending on the result of the power-on-self-test.

The trim control system 1 preferably includes a manual mode, a diagnostic mode, a program mode and a preset mode. The type of mode is selected through an input actuator on the control panel 12. When the trim control system 1 is in program mode, input actuators 13 on the control panel 12 will be used to set the positions of the drive devices 20 and trim devices 22. The positions of the drive and trim devices may be based on information from operational parameter sensors 24, such as throttle position, engine speed and vessel speed. The operational parameters 24 are preferably shown on the display device 14 for operator use. When an operator has the drive and trim devices in the desired position, the positions may be recorded in memory at operator request via the control panel 12. Recorded positions are accessed by trim control system 1, through the control panel 12, when in the preset mode.

When the trim control system 1 is in manual mode; the operator is able to set the positions of the drive and trim devices. The trim control system 1 will not intervene in manual mode. The trim control system 1 will preferably revert from program mode to preset mode based on operator input from the control panel 12.

The diagnostic mode is accessed through the control panel 12 or the display device monitor 14 and may be used for troubleshooting and fault detection. The manual fault detection includes the ability to manually command the test of any of the control system inputs and outputs for faults or out of tolerance conditions. Additionally, the manual mode preferably allows the operator to manually manipulate the outputs of the controller 10. Any input/output calibrations of the trim or drive devices are to be completed in the manual mode of operation.

When the trim control system 1 is in preset mode, the operator will select from the control panel 12, previously stored positions of the drive devices 20 and trim devices 22. The trim control system 1 manipulates the drive and trim devices to obtain and maintain the pre-selected positions.

Additionally, the trim control system 1 automatically positions, based on previously stored values, the drive devices, when transmission engagement occurs. The trim control system 1 includes unique positions for each direction of engagement. A pre-selected position is maintained, until the operator chooses a new pre-select position, the operator manipulates the control panel 12 or a control input/output fault is detected.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A programmable trim control system for marine applications comprising:

a controller having at least one output port and at least one input port;

at least one drive device being connected to said at least one output port;

at least one trim device being connected to said at least one output port;

setting the positions of at least one of said at least one drive and at least one trim device, said position being recorded by said controller; and said controller capable in operation of positioning the at least one of said at least one drive and at least one trim device according to data stored in memory through operator command in preset mode.

2. The programmable trim control system for marine applications of claim 1, further comprising:

at least one drive sensor for sensing the position of said at least one drive device, at least one trim sensor for sensing the position of said at least one trim device.

3. The programmable trim control system for marine applications of claim 1, further comprising:

a control panel for entering said positions of the at least one of said at least one drive and at least one trim device into said controller.

4. The programmable trim control system for marine applications of claim 1, further comprising:

a display device for monitoring said controller.

5. The programmable trim control system for marine applications of claim 1, further comprising:

said controller including fault detection monitoring for at least one of said at least one input and at least one output port.

6. The programmable trim control system for marine applications of claim 1, further comprising:

said controller reverting from said preset mode to a manual mode of operation if a fault is detected or manual controls are manipulated.

7. The programmable trim control system for marine applications of claim 1, further comprising:

said controller allowing operator commanded fault detection and manipulation of at least one of said at least one drive and at least one trim device while in a diagnostic mode.

8. The programmable trim control system for marine applications of claim 1, further comprising:

at least one operational parameter sensor for sensing at least one operational parameter, said at least one operational parameter sensor being connected to said at least one input port.

9. A programmable trim control system for marine applications comprising:

a controller having at least one output port and at least one input port;

at least one drive device being connected to said at least one output port;

at least one trim device being connected to said at least one output port;

at least one operational parameter sensor for sensing at least one operational parameter, said at least one operational parameter sensor being connected to said at least one input port;

a control panel for entering the position of at least one of said at least one drive and at least one trim device for said at least one operational parameter into said controller, said positions of the at least one drive and at least one trim device being recorded by said controller; and said controller capable in operation of positioning the at least one of said at least one drive and at least one trim device according to data stored in memory through operator command.

10. The programmable trim control system for marine applications of claim 9, further comprising:

at least one drive sensor for sensing the position of said at least one drive device, at least one trim sensor for sensing the position of said at least one trim device.

11. The programmable trim control system for marine applications of claim 9, further comprising:

a display device for monitoring said controller.

12. The programmable trim control system for marine applications of claim 9, further comprising:

said controller including fault detection monitoring for at least one of said at least one input and at least one output port.

13. The programmable trim control system for marine applications of claim 9, further comprising:

said controller reverting from a preset mode to a manual mode of operation if a fault is detected or manual controls are manipulated.

14. The programmable trim control system for marine applications of claim 9, further comprising:

said controller allowing operator commanded fault detection and manipulation of at least one said at least one drive and at least one trim device while in a diagnostic mode.

15. A programmable trim control system for marine applications comprising:

a controller having at least one output port and at least one input port;

at least one drive device being connected to said at least one output port;

at least one trim device being connected to said at least one output port;

at least one drive sensor for sensing the position of said at least one drive device, at least one trim sensor for sensing the position of said at least one trim device; and setting the position of at least one of said at least one drive and at least one trim device, said position being recorded by said controller said controller including fault detection monitoring for said at least one input port and at least one output port.

16. The programmable trim control system for marine applications of claim 15, further comprising:

said controller positioning the at least one said at least one drive and at least one trim device according to data stored in memory through operator command in a preset mode.

17. The programmable trim control system for marine applications of claim 15, further comprising:

a control panel for entering said positions of the at least one said at least one drive and at least one trim device.

18. The programmable trim control system for marine applications of claim 15, further comprising:

a display device for monitoring said controller.

19. The programmable trim control system for marine applications of claim 15, further comprising:

at least one operational parameter sensor for sensing at least one operational parameter, said at least one operational parameter sensor being connected to said at least one input port.

20. The programmable trim control system for marine applications of claim 16, further comprising:

said controller reverting from said preset mode to a manual mode of operation if a default is detected or manual controls are manipulated.

21. The programmable trim control system for marine applications of claim 15, further comprising:

said controller allowing operator commanded fault detection and manipulation of at least one of said at least one drive and at least one trim device while in a diagnostic mode.

* * * * *

UNITED STATES PATENT AND TRADEMARK OFFICE

CERTIFICATE OF CORRECTION

PATENT NO. : 7,617,026 B2
APPLICATION NO. : 11/436072
DATED : November 10, 2009
INVENTOR(S) : Michael B. Gee et al.

It is certified that error appears in the above-identified patent and that said Letters Patent is hereby corrected as shown below:

Title page, Item (75) - Inventors: Delete "Russel E. Gates" and insert --Russell E. Gates,--.

Claim 1, column 5, line 3, "positions" should appear as "position".

Claim 3, column 5, line 17, "positions" should appear as "position".

Claim 9, column 5, line 59, "positions" should appear as "position".

Claim 17, column 6, line 45, "positions" should appear as "position".

Signed and Sealed this

Nineteenth Day of January, 2010

David J. Kappos

David J. Kappos
*Director of the United States Patent and Trademark Office*